US009718286B2

(12) United States Patent
Dolz et al.

(10) Patent No.: US 9,718,286 B2
(45) Date of Patent: Aug. 1, 2017

(54) SHEET-TRANSPORT DRUM AND PRINTING MACHINE WITH A SHEET-TRANSPORT DRUM

(71) Applicant: HEIDELBERGER DRUCKMASCHINEN AG, Heidelberg (DE)

(72) Inventors: Wolfgang Dolz, Heidelberg (DE); Raimund Schroeder, Hockenheim (DE); Arno Juenger, Walldorf (DE); Daniel Conzelmann, Dielheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/188,005

(22) Filed: Jun. 21, 2016

(65) Prior Publication Data

US 2016/0368287 A1 Dec. 22, 2016

(30) Foreign Application Priority Data

Jun. 22, 2015 (DE) ..... 10 2015 211 440

(51) Int. Cl.

| | |
|---|---|
| ***B41J 11/00*** | (2006.01) |
| ***B41F 21/04*** | (2006.01) |
| ***B41J 21/10*** | (2006.01) |
| ***B41F 21/00*** | (2006.01) |

(Continued)

(52) U.S. Cl.

CPC ..... *B41J 11/0085* (2013.01); *B41F 21/00* (2013.01); *B41F 21/04* (2013.01); *B41F 21/102* (2013.01); *B41J 2/01* (2013.01)

(58) Field of Classification Search

CPC ..... B41J 11/0085; B41J 2/01; B41F 21/04; B41F 21/00; B41F 21/102

See application file for complete search history.

(56) References Cited

U.S. PATENT DOCUMENTS

| | | | |
|---|---|---|---|
| 5,172,634 | A | 12/1992 | Iwamoto |
| 6,659,456 | B2 | 12/2003 | Hieb |
| 7,150,456 | B2 | 12/2006 | Gerstenberger et al. |

(Continued)

FOREIGN PATENT DOCUMENTS

| | | | |
|---|---|---|---|
| DE | 4221046 | A1 | 1/1994 |
| DE | 10102226 | A1 | 7/2002 |

(Continued)

*Primary Examiner* — Geoffrey Mruk

(74) *Attorney, Agent, or Firm* — Laurence A. Greenberg; Werner H. Stemer; Ralph E. Locher

(57) ABSTRACT

A sheet-transport drum includes at least two sheet-supporting surfaces with suction openings. Each respective sheet-supporting surface is formed of first and second comb segments with segment teeth. Suction grooves are provided in the segment teeth and a trailing-edge suction groove is provided in the sheet-supporting surface of each respective second comb segment. A rotary valve is provided for a timed supply of suction air. A plurality of vacuum sources is provided and a trailing-edge suction groove is assigned to each respective vacuum source by the rotary valve. This ensures that the vacuum provided by a respective trailing-edge suction groove at the trailing edge of a respective sheet is reliably maintained even if a previous or following sheet is missing. A sheet-fed printing machine with the sheet-transport drum is also provided.

11 Claims, 4 Drawing Sheets

(51) Int. Cl.
*B41F 21/10* (2006.01)
*B41J 2/01* (2006.01)

(56) References Cited

U.S. PATENT DOCUMENTS

| | | | | |
|---|---|---|---|---|
| 2004/0084837 | A1* | 5/2004 | Gerstenberger ..... | B41F 21/108<br>271/275 |
| 2009/0284561 | A1 | 11/2009 | Fukui | |
| 2015/0246525 | A1 | 9/2015 | Maul et al. | |

FOREIGN PATENT DOCUMENTS

| | | | |
|---|---|---|---|
| DE | 102014002907 | B3 | 3/2015 |
| EP | 1415804 | A1 | 5/2004 |

* cited by examiner

SHEET-TRANSPORT DRUM AND PRINTING MACHINE WITH A SHEET-TRANSPORT DRUM

CROSS-REFERENCE TO RELATED APPLICATION

This application claims the priority, under 35 U.S.C. §119, of German Patent Application DE 10 2015 211 440.6, filed Jun. 22, 2015; the prior application is herewith incorporated by reference in its entirety.

BACKGROUND OF THE INVENTION

Field of the Invention

The invention relates to a sheet-transport drum in a sheet-processing machine. The drum includes at least two sheet-supporting surfaces with suction openings. Each respective sheet-supporting surface is formed of a first comb segment and a second comb segment. The comb segments have segment teeth with suction grooves formed therein. A trailing-edge suction groove is provided in the sheet-supporting surface of a respective second comb segment and a rotary valve provides a timed supply of suction air. The invention also relates to a sheet-fed printing machine, in particular a digital printing machine, including a sheet-transport drum with vacuum sources.

The use of digital printing machines to print shorts runs or customized printed images on sheets of paper, paperboard, and cardboard is known in the art. When inkjet heads are used to print on the sheets, a transport system moves a respective sheet underneath the inkjet heads at a minimum distance. Known transport systems are revolving transport belts, for instance embodied as suction belts, and rotating cylinders, also known as jetting cylinders, or revolving tables.

Machine concepts that use cylinders as described, for instance, in U.S. Patent Application Publication US 2009/0284561 A1, include a number of inkjet print heads disposed above a jetting cylinder to print on sheets that are moved past at a short distance from the print heads. A jetting cylinder may simultaneously hold a plurality of sheets by suction and transport them.

In order to guarantee a high printing quality and to avoid damage to the print heads, an important aspect is to ensure that a respective sheet rests securely on the jetting cylinder. If a sheet does not rest securely thereon and if dog ears stick out, for instance, they may damage the print heads. In order to prevent that, it is known to equip the printing machine with a detection device and to quickly stop the machine if there are any corners or edges that stick out. However, that means a considerable reduction of the throughput of the machine.

Sheet-transport drums including gripper systems for holding the sheets to be transported are known as devices for guiding sheets and are disclosed, for instance, in German Patent Application DE 42 21 046 A1, corresponding to U.S. Pat. No. 5,172,634, German Patent Application DE 101 02 226 A1, corresponding to U.S. Pat. No. 6,659,456, and European Patent Application EP 1 415 804 A1, corresponding to U.S. Pat. No. 7,150,456. The latter discloses a sheet-transport drum with sheet-supporting surfaces formed of two comb segments. In order to ensure that a sheet resting thereon is held securely, the comb segments have suction grooves that are supplied with suction air by using a rotary valve disposed inside the sheet-transport drum.

A disadvantage of such a sheet-transport drum is that the suction air breaks down if there is a sheet-supporting surface with no sheet resting thereon and the further sheets on the drum may no longer be held securely as a consequence. That is the case during the start-up and shutdown of the printing machine and when defective sheets are discharged before they reach the sheet-transport drum.

SUMMARY OF THE INVENTION

It is accordingly an object of the invention to provide a sheet-transport drum and a sheet-fed printing machine with a sheet-transport drum, which overcome or at least reduce the hereinafore-mentioned disadvantages of the heretofore-known sheet-transport drums and printing machines of this general type and in which sheets are securely held on the sheet-transport drum even if previous or subsequent sheets are missing.

With the foregoing and other objects in view there is provided, in accordance with the invention, a sheet-transport drum in a machine for processing sheets, which comprises at least two sheet-supporting surfaces having suction openings wherein a respective sheet-supporting surface is formed of a first comb segment and a second comb segment with segment teeth embodied in a rake-like way and meshing with one another. Suction grooves are formed in the segment teeth of the first and second comb segments and a trailing-edge suction groove is provided in the sheet-supporting surface of a respective second comb segment, the trailing-edge suction groove being associated with a trailing edge of a sheet resting on the sheet-supporting surface. A rotary valve is provided to supply suction air to the suction grooves and to the trailing-edge suction groove. The sheet-transport drum advantageously includes a plurality of vacuum sources and the rotary valve exclusively assigns a single trailing-edge suction groove of a respective sheet supporting surface to a respective vacuum source. The suction grooves of the comb segments are likewise assigned to at least one vacuum source. This is achieved by a provision of corresponding channels or, to be more precise, supply lines and taps or air control openings in the rotary valve. The provision of a plurality of vacuum sources ensures that the vacuum that is present at the trailing edge of a respective sheet and is provided by a respective trailing-edge suction groove is reliably maintained even if a previous or subsequent sheet is missing.

In a particularly advantageous and thus preferred further development of the sheet-transport drum of the invention, the latter has a transfer region for receiving sheets from an upstream transfer cylinder. In the transfer region, a separate vacuum source is assigned to the suction grooves of the comb segments by the rotary valve. This ensures that in the transfer region, a respective sheet may reliably be "ironed" onto the sheet-transport drum, avoiding bulges in the sheet and preventing corners of the sheet from sticking out.

In an advantageous further development of the sheet-transport drum of the invention, a further vacuum source is provided to provide suction air to the suction grooves of the comb segments in the remaining area of the sheet-transport drums, i.e. outside the transfer region, by using the rotary valve.

It is furthermore deemed advantageous to operate the vacuum sources at different pressure levels, i.e. to use respective vacuum sources with an adjustable pressure, for instance to cause sheets to be held by a particularly strong suction effect in the transfer region and underneath print heads.

In an advantageous embodiment of the sheet-transport drum the comb segments have air control holes, also referred to as taps, that interact with the rotary valve to tap into the vacuum at the rotary valve. For this purpose, supply lines are located in the rotary valve. Thus a supply line to supply the trailing-edge suction groove, a further supply line to supply the suction grooves of the respective first comb segment, and a further supply line to supply the suction grooves of the respective second comb segment may be provided, i.e. introduced in the rotary valve.

In a particularly advantageous and thus preferred further development, the supply line of the trailing-edge suction groove is subdivided into separate sections in such a way that every section provides suction air to only one trailing-edge suction groove of a respective sheet-supporting surface. In other words, the length of the individual sections is selected in such a way that the suction air supply transitions to the next section before the supply of the subsequent trailing-edge suction groove of the next sheet-supporting surface is connected to the section. This definitely precludes any mutual influence between the different sheet-supporting surfaces. Furthermore, every section of the supply line of the trailing-edge suction groove may be connected to a separate vacuum source.

In an advantageous embodiment, the sheet-transport drum is embodied as a jetting cylinder for holding and transporting sheets to be printed in an inkjet process.

With the objects of the invention in view, there is concomitantly provided a sheet-fed printing machine comprising a sheet-transport drum as described above. The latter may be embodied as a digital printing machine, in particular one including inkjet heads disposed at a distance from and substantially above the sheet-transport drum.

Other features which are considered as characteristic for the invention are set forth in the appended claims. Inasmuch as this makes sense from a technical point of view, the invention described above and the advantageous further developments thereof described herein also form advantageous further developments of the invention in combination with one another.

Although the invention is illustrated and described herein as embodied in a sheet-transport drum and a printing machine with a sheet-transport drum, it is nevertheless not intended to be limited to the details shown, since various modifications and structural changes may be made therein without departing from the spirit of the invention and within the scope and range of equivalents of the claims. Further advantages and embodiments of the invention that are advantageous in structural and functional terms will become apparent from the dependent claims and from the description of exemplary embodiments with reference to the appended figures.

The construction and method of operation of the invention, however, together with additional objects and advantages thereof will be best understood from the following description of specific embodiments when read in connection with the accompanying drawings.

DETAILED DESCRIPTION OF THE INVENTION

Figure 4:
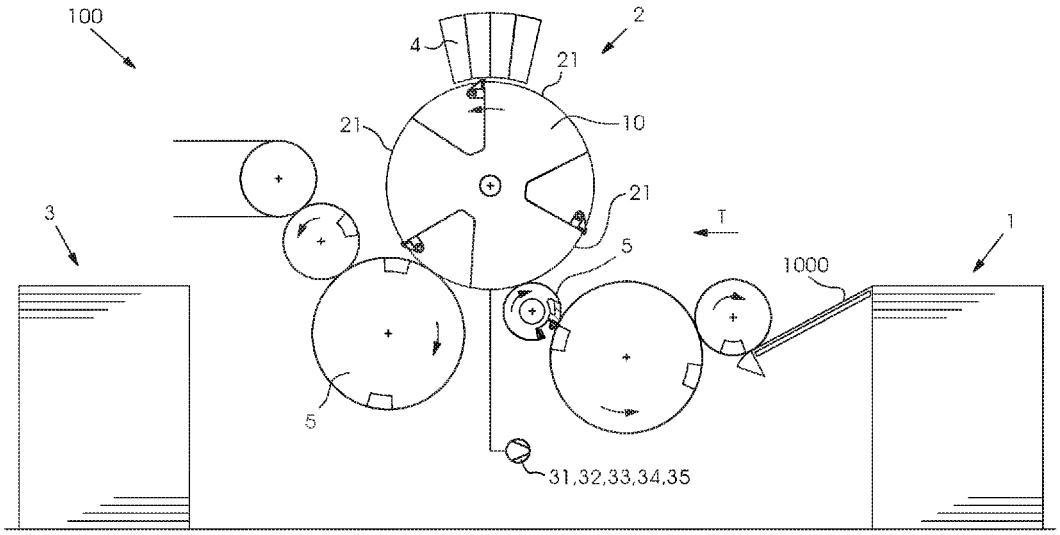
FIG. 4 is a longitudinal-sectional view of a digital printing machine.

Referring now in detail to the figures of the drawings, which are not drawn to scale and in which mutually corresponding elements and components have the same reference numerals, and first, particularly, to FIG. 4 thereof, there is seen a sheet-fed printing machine 100 embodied as a digital printing machine. A respective sheet 1000 coming from a feeder 1 is transported through a printing unit 2 to a delivery 3 in a direction of transport T. The transport of a respective sheet 1000 is mainly carried out by cylinders, namely transfer cylinders 5 and a sheet-transport drum 10, embodied as a jetting cylinder. In the exemplary embodiment, the jetting cylinder 10 has three sheet-supporting areas 21. Inkjet heads 4 are disposed above the jetting cylinder 10. The inkjet heads 4 print on a sheet 1000 that is transported past by the jetting cylinder 10 at a short distance. Vacuum sources 31, 32, 33, 34, 35 for securely holding sheets 1000 by suction in the region of the sheet-supporting surface 21 and during transport and printing are assigned to the jetting cylinder 10.

Figure 2:
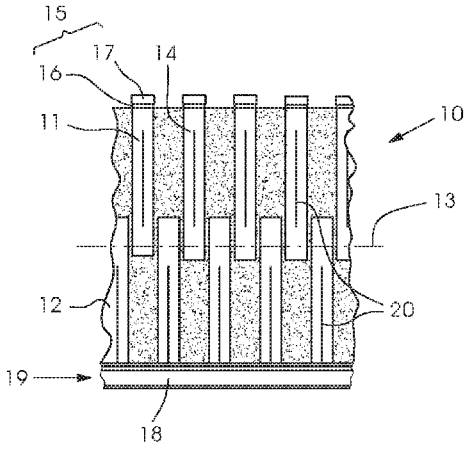
FIG. 2 is a fragmentary, top-plan view of the sheet-transport drum.
Figure 3:
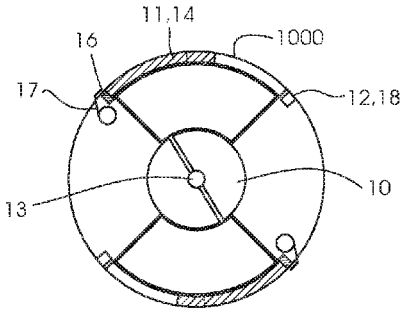
FIG. 3 is a partly-sectional, end-elevational view of the sheet-transport drum.

FIG. 2 is a top view of the sheet-transport drum 10 and FIG. 3 is a lateral sectional view of the sheet-transport drum 10 of FIG. 2. FIG. 2 shows that the sheet-transport drum 10 includes at least a first comb segment 11 and a second comb segment 12. The second comb segment 12 is supported to rotate/pivot relative to the first comb segment 11 about a pivot axis 13, which corresponds to the central axis of the sheet-transport drum 10, to adapt the sheet-transport drum 10 to sheets 1000 of different format lengths to be transported. Each one of the comb segments 11, 12 has teeth 14 that engage in interspaces between the teeth 14 of the respective other comb segment 12, 11.

The second comb segment 12 is adjusted towards the first comb segment 11 to accommodate a smaller sheet format by moving the teeth 14 deeper into the interspaces which causes the interspaces to narrow. In order to accommodate a larger sheet format, the second comb segment 12 is moved away from the first comb segment 11, causing the interspaces to widen.

A gripper system 15 of the sheet-transport drum 10 has gripper pads 16 and gripper fingers 17 associated therewith on the front edge of the first comb segment 11 to clamp the sheet 1000 of printing material. A pneumatic gripper 19 has a trailing-edge suction groove 18 connected to a (non-illustrated) suction air source for holding the sheet 1000 of printing material by suction at its trailing edge is disposed on the second comb segment 12. A number of suction nozzles disposed in a row may be used instead of the trailing-edge suction groove 18. The mechanical grippers 15 at the leading edge of the sheets and the pneumatic grippers 19 at the trailing edge of the sheets are crucial for a secure transport of the sheets 1000. The gripper systems 15, 19 ensure that the sheets 1000 are held down at their corners and edges and that the sheets 1000 may be moved past underneath inkjet heads 4 at a defined, short distance. The first comb segment 11 and the second comb segment 12 are provided with suction grooves 20 that ensure that a sheet 1000 is held securely over its entire surface without any bulges.

Figure 1A:
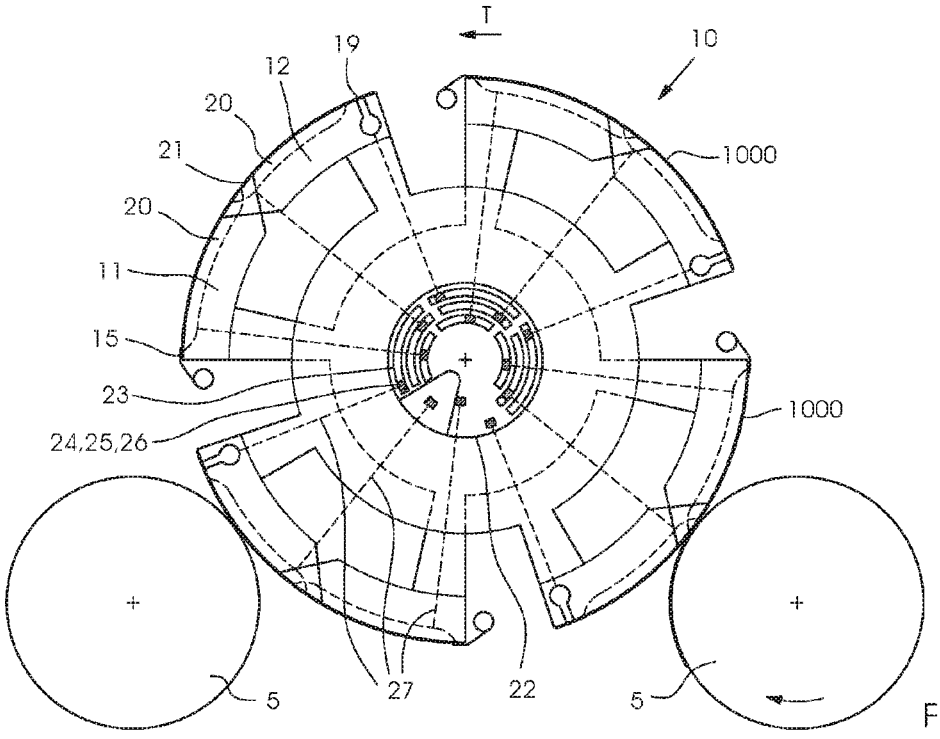
FIGS. 1A and 1B are cross-sectional views of the sheet-transport drum of the invention and its rotary valve.
Figure 1B:
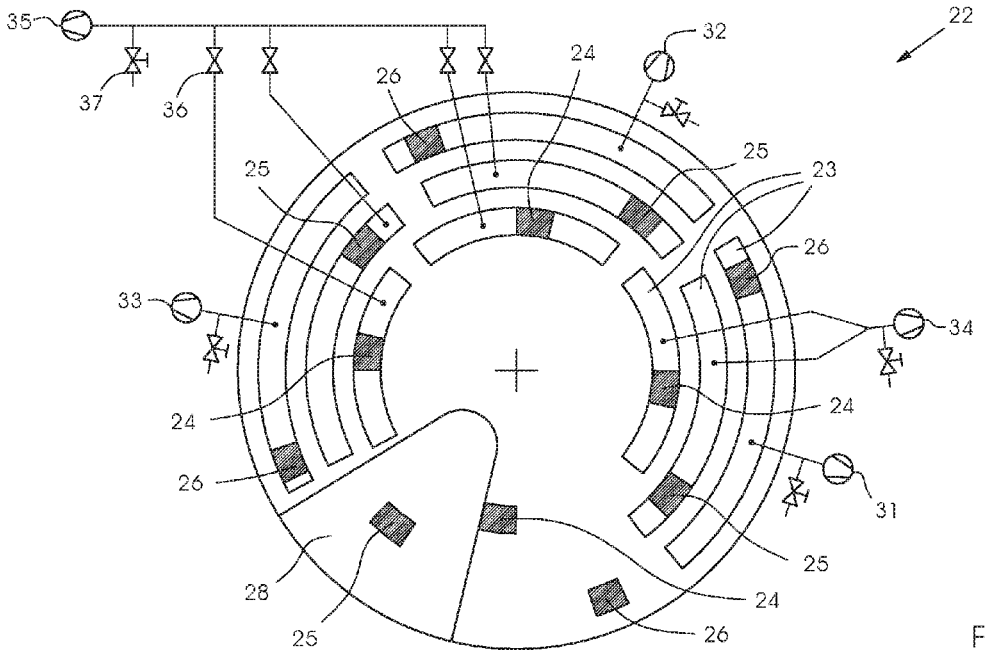

FIG. 1A is a more detailed sectional view of the suction air supply of the sheet-transport drum 10. In the illustrated embodiment, the sheet-transport drum has four sheet-supporting surfaces 21, each of which has a mechanical gripper 15 for gripping the leading edge, suction grooves 20 formed in the comb segments 11, 12 for holding the sheet over its entire surface, and a pneumatic gripper 19 for holding the trailing edge of a sheet 1000. A rotary valve 22 is disposed at the center/in the middle of the sheet-transport drum 10 to supply the suction grooves and trailing-edge suction grooves 20, 18 with suction air. For this purpose, the trailing-edge suction grooves and suction grooves 20, 18 are connected to the rotary valve 22 by suction lines 27. The rotary valve 22 has a plurality of fixed supply lines 23 that interact with revolving taps or air control holes 24, 25, 26 and create a timed provision of suction air. The construction of the rotary valve 22 is shown in more detail in FIG. 1B.

The rotary valve 22 has three different supply lines 23, which are disposed on different radii of the rotary valve 22. The innermost supply line 23 serves to provide suction air to the suction grooves 20 of the first comb segments 11. The middle supply line 23 serves to provide suction air to the suction grooves 20 of the second comb segments 12. This ensures a reliable suction air supply even in the case of format changes. Finally, the outer supply line 23 serves to provide suction air to the pneumatic trailing-edge grippers 19. Each respective supply line 23 is subdivided into three sections. The three sections of each respective supply line 23 are connected to different vacuum sources 31, 32, 33, 34, 35.

In every segment of the sheet-transport drum 10, each of which has a sheet-supporting surface 21, i.e. the comb segments 11, 12, air control openings are provided, which will be referred to as taps below. Thus for every sheet-supporting surface 21, there is a revolving tap 24 associated with the rotary valve 22 for the front suction grooves 20 of the first comb segment 11, a revolving tap 25 associated with the rotary valve 22 for the rear suction grooves 20 in the second comb segment 12, and a revolving tap 26 for the pneumatic trailing-edge grippers 19 of the second comb segment 12.

Every section of a supply line 23 that interacts with the tap 26 to provide the pneumatic trailing-edge grippers 19 with suction air is connected to its own vacuum source. The first section is connected to a first vacuum source 31, the second section to a second vacuum source 32, and the third section to a third vacuum source 33. This prevents any mutual influence in terms of the suction power and ensures that the pneumatic gripper 19 may attract and hold the trailing edge of the sheet by suction at any time. In addition, the rotary valve 22 has the following features:

The length of the individual sections of the fixed supply lines 23 in the rotary valve 22 is selected in such a way that the supply of suction air to the trailing-edge suction groove 18 transitions to the next section before the supply to a following sheet-supporting surface 21 is connected to the section of the fixed line 23. Thus there is no mutual influence on the suction effect of the trailing-edge suction grooves 18 of the different sheet-supporting surfaces 21, for instance because on one sheet-supporting surface 21 a sheet 1000 is missing.

The first sections of the supply line 23, which interacts with the tap 24 for the front grooves and the tap 25 for the rear grooves, are connected to a separate vacuum source 34. This means that in a transfer region of the sheet-transport drum 10, a sheet 1000 may be "ironed" onto the sheet-supporting surface 21 over the entire surface of the sheet by an upstream transfer cylinder 5. In further sections, a further vacuum source 35 is assigned to the central and outer supply lines 23, which interact with the revolving taps 24 of the front grooves and the revolving taps 25 of the rear grooves. In order to reduce the mutual influence, respective throttling points 36 are provided between the sections of the supply line 23 and the vacuum source 35 in the supply lines.

The rotary valve 22 also has a region that is not provided with supply lines 23. In this region there is an opening that causes aeration 28 at the trailing-edge suction groove and at the suction grooves 18, 20 as soon as a sheet 1000 is transferred from the sheet-transport drum 10 to a downstream transfer cylinder 5. The aeration 28 reduces the vacuum, aerates the trailing-edge suction groove and the suction grooves 18, 20, and thus facilitates a transfer of the sheet 1000.

The invention claimed is:

1. A sheet-transport drum in a sheet-processing machine, the sheet-transport drum comprising:

at least two sheet-supporting surfaces having suction openings formed therein, each of said sheet-supporting surfaces being formed of a respective first comb segment and a respective second comb segment, said comb segments having segment teeth with suction grooves formed therein;

each of said second comb segments of said at least two sheet-supporting surfaces having a respective trailing-edge suction groove formed therein;

a plurality of vacuum sources; and a rotary valve for providing a timed supply of suction air, said rotary valve associating each of said trailing edge-suction grooves with a respective one of said vacuum sources.

2. The sheet-transport drum according to claim 1, which further comprises a transfer region of the sheet-transport drum in which a separate vacuum source of said plurality of vacuum sources is associated with said suction grooves by said rotary valve.

3. The sheet-transport drum according to claim 2, wherein a further vacuum source of said plurality of vacuum sources is associated with said suction grooves by said rotary valve.

4. The sheet-transport drum according to claim 1, wherein said vacuum sources are operable at different pressure levels.

5. The sheet-transport drum according to claim 1, wherein said comb segments have air control holes formed therein interacting with said rotary valve, and said rotary valve has supply lines located therein for said air control holes (24, 25, 26).

6. The sheet-transport drum according to claim 5, wherein said supply lines are formed in said rotary valve and include a supply line for supplying said trailing-edge suction groove, a supply line for supplying said suction grooves of said respective first comb segments, and a supply line for supplying said suction grooves of said respective second comb segment.

7. The sheet-transport drum according to claim 6, wherein at least said supply line for said trailing-edge suction groove is subdivided into separate sections and each one of said sections provides suction air to only one respective trailing-edge suction groove.

8. The sheet-transport drum according to claim 7, wherein each of said sections is connected to a respective one of said vacuum sources.

9. The sheet-transport drum according to claim 1, wherein the sheet-transport drum is a jetting cylinder.

10. A printing machine, comprising a sheet-transport drum with vacuum sources according to claim 1.

11. A digital printing machine, comprising a sheet-transport drum with vacuum sources according to claim 1.

* * * * *